US009587843B2

(12) United States Patent
Yamashita et al.

(10) Patent No.: US 9,587,843 B2
(45) Date of Patent: Mar. 7, 2017

(54) AIR-CONDITIONING APPARATUS AND RELAY UNIT

(75) Inventors: Koji Yamashita, Tokyo (JP); Hiroyuki Morimoto, Tokyo (JP); Yuji Motomura, Tokyo (JP); Takeshi Hatomura, Tokyo (JP); Naoki Tanaka, Tokyo (JP); Shinichi Wakamoto, Tokyo (JP); Takashi Okazaki, Tokyo (JP); Yusuke Shimazu, Tokyo (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 623 days.

(21) Appl. No.: 13/056,826

(22) PCT Filed: Oct. 29, 2008

(86) PCT No.: PCT/JP2008/069598

§ 371 (c)(1),
(2), (4) Date: Apr. 28, 2011

(87) PCT Pub. No.: WO2010/049998

PCT Pub. Date: May 6, 2010

(65) Prior Publication Data

US 2011/0192184 A1 Aug. 11, 2011

(51) Int. Cl.
*F25B 41/04* (2006.01)
*F24F 3/06* (2006.01)
(Continued)

(52) U.S. Cl.
CPC ..... *F24F 3/06* (2013.01); *F24F 1/02* (2013.01); *F25B 13/00* (2013.01); *F25B 5/04* (2013.01);
(Continued)

(58) Field of Classification Search
CPC ..... F24F 3/06; F24F 1/02; F25B 13/00; F25B 2313/003
(Continued)

(56) References Cited

U.S. PATENT DOCUMENTS 4,944,158 A * 7/1990 Akiike et al. ..... 62/81
5,063,752 A * 11/1991 Nakamura et al. ..... 62/225
(Continued)

FOREIGN PATENT DOCUMENTS

JP 3-017475 A 1/1991
JP 4-103933 A 4/1992
(Continued)

OTHER PUBLICATIONS

Takashi et al., Refrigeration Cycle System, Dec. 3, 2003, JP2003343936A, Whole Document.*
(Continued)

*Primary Examiner* — Larry Furdge
(74) *Attorney, Agent, or Firm* — Buchanan Ingersoll & Rooney PC

(57) ABSTRACT

A refrigeration cycle is configured by connecting a compressor, a four-way valve, a heat source side heat exchanger, expansion valves, and intermediate heat exchangers by piping. A heat medium circulation circuit is configured by connecting intermediate heat exchangers, pumps, and use side heat exchangers by piping. The outdoor unit accommodates the compressor, the four-way valve, and the heat source side heat exchanger, and the relay unit that is installed in a non-subject space which is different from an indoor space and is on an installation floor separated by two or more floors and accommodates the expansion valves, the pump, and intermediate heat exchangers are connected by two pipelines. The relay unit and an indoor unit that accommodates use side heat exchangers and is installed at a position
(Continued)

where an indoor space can be air-conditioned are connected by two pipelines.

16 Claims, 9 Drawing Sheets

(51) Int. Cl.

| | |
|---|---|
| ***F24F 1/02*** | (2011.01) |
| ***F25B 13/00*** | (2006.01) |
| *F25B 5/04* | (2006.01) |
| *F25B 25/00* | (2006.01) |
| *F25B 43/04* | (2006.01) |

(52) U.S. Cl.
CPC ..... *F25B 25/005* (2013.01); *F25B 43/04* (2013.01); *F25B 2313/003* (2013.01); *F25B 2313/006* (2013.01); *F25B 2313/0231* (2013.01); *F25B 2313/0233* (2013.01); *F25B 2313/0272* (2013.01); *F25B 2400/24* (2013.01); *F25B 2500/01* (2013.01)

(58) Field of Classification Search
USPC ..... 62/160, 175
See application file for complete search history.

(56) References Cited

U.S. PATENT DOCUMENTS

| | | | | |
|---|---|---|---|---|
| 5,245,837 | A * | 9/1993 | Kitamoto | 62/175 |
| 5,582,023 | A * | 12/1996 | O'Neal | 62/195 |
| 5,632,154 | A * | 5/1997 | Sibik et al. | 62/99 |
| 6,474,081 | B1 * | 11/2002 | Feuerecker | 62/99 |
| 6,511,373 | B2 * | 1/2003 | Howard et al. | 454/298 |
| 2006/0070719 | A1 * | 4/2006 | Kim et al. | 165/61 |

FOREIGN PATENT DOCUMENTS

| | | | | | |
|---|---|---|---|---|---|
| JP | 5-280818 | A | | 10/1993 | |
| JP | 5-306849 | A | | 11/1993 | |
| JP | 8-261517 | A | | 10/1996 | |
| JP | 11-344240 | A | | 12/1999 | |
| JP | 2003-343936 | A | | 12/2003 | |
| JP | 2003343936 | A | * | 12/2003 | |
| JP | 2004044948 | A | * | 2/2004 | F25B 6/04 |
| JP | 2004053069 | A | * | 2/2004 | F25B 1/00 |
| JP | 2005-069552 | A | | 3/2005 | |
| JP | 2005-249258 | A | | 9/2005 | |
| JP | 2006-029744 | A | | 2/2006 | |
| JP | 2006029744 | A | * | 2/2006 | F24F 5/00 |

OTHER PUBLICATIONS

Office Action (Notification of Reasons for Rejection) dated Oct. 23, 2012, issued in corresponding Chinese Patent Application No. 200880130552.7, and an English Translation thereof. (14 pages).
International Search Report (PCT/ISA/210) for PCT/JP2008/069598 dated Jan. 20, 2009.
Office Action (Notice of Reasons for Rejection) dated Aug. 14, 2012, issued in corresponding Japanese Patent Application No. 2010-535541, and an English Translation thereof. (6 pages).
Office Action issued on Oct. 17, 2013, by the Chinese Patent Office in corresponding Chinese Patent Application No. 2008801305527, and an English Translation of the Office Action. (15 pages).
Office Action (Text Portion of the Notification of the Second Office Action) dated May 27, 2013, issued in corresponding Chinese Patent Application No. 200880130552.7, and an English Translation thereof. (13 pages).
Jun. 2, 2014 European Search Report issued in European Patent Application No. 08877710.7.
Office Action (Portion of the Reexamination Notification) issued on Nov. 19, 2014, by the China Patent Office in corresponding Chinese Patent Application No. 200880130552.7, and an English Translation of the Office Action. (19 pages).
Nov. 18, 2015 European Office Action issued in European Application No. 08 877 710.7.
Office Action (Communication pursuant to Article 94(3) EPC) issued on Apr. 29, 2015, by the European Patent Office in corresponding European Patent Application No. 08 877 710.7-1602. (5 pages).
Office Action issued on Mar. 9, 2015, by the Chinese Patent Office in corresponding Chinese Patent Application No. 200880130552.7 and an English translation of the Office Action. (6 pages).
Jun. 22, 2016 European Office Action issued by European Patent Office in European Application No. 08 877 710.7.

* cited by examiner

AIR-CONDITIONING APPARATUS AND RELAY UNIT

TECHNICAL FIELD

The present invention relates to an air-conditioning apparatus used for a multiple-air conditioner for buildings for example.

BACKGROUND ART

In an air-conditioner apparatus such as a multi air-conditioner for buildings, a refrigerant is made to circulate between an outdoor unit, which is a heat source apparatus disposed outside of a building, and an indoor unit disposed inside of the building for example. Through release or absorption of heat by the refrigerant, the heated or cooled air has performed cooling or heating for the space to be air-conditioned. As for the refrigerant, HFC (hydrofluorocarbon) refrigerant is often used, for example. Alternatively, a natural refrigerant such as carbon dioxide ($CO_2$) is proposed, as well.

In an air-conditioner apparatus called a chiller, cooling energy or heating energy is generated in the heat source apparatus disposed outside the building. By heating or cooling water, anti-freezing liquid and the like in a heat exchanger disposed in the outdoor unit and carrying it to a fan coil unit, a panel heater and the like, which is the indoor unit, cooling or heating has been performed. There also is a heat source apparatus called a waste heat recovery type chiller in which four water pipelines are connected to the heat source apparatus to supply cooled or heated water and the like simultaneously. (Refer to
Patent Literature 1, for example)
Patent Literature 1 JP2003-343936

SUMMARY OF INVENTION

Technical Problem

In the conventional air-conditioner apparatus, since the refrigerant is made to circulate into the indoor unit, the refrigerant may be leaked indoors. On the other hand, the air-conditioner apparatus like the chiller, no refrigerant passes through the indoor unit. However, it is necessary to heat or cool water, the anti-freezing liquid and the like in the heat source apparatus outside the building to carry it to the indoor unit side. Therefore, a circulation path of water, anti-freezing liquid and the like becomes longer. Here, when trying to transfer heat that performs a predetermined heating or cooling operation with water, anti-freezing liquid and the like, energy consumption becomes larger than the refrigerant. Therefore, if a circulation path becomes longer, carrying power grows too large and energy saving is hardly achieved as a result. Further, since the heat source apparatus heats and cools water, anti-freezing liquid and the like, the number of pipelines increases, when trying to carry both the water for heating and water for cooling to the indoor unit side simultaneously. Therefore, it has taken time for construction such as installation work.

The present invention is made to solve the above problems and its object is to provide an air-conditioner apparatus that is safe since no problem of leaking indoors of the refrigerant occurs unlike an air-conditioner apparatus such as a multi air-conditioner for buildings because no refrigerant is made to circulate into the indoor unit, that can achieve energy-saving because a water circulation path is shorter than the air-conditioner apparatus such as a chiller, and that is installed easily.

The air-conditioner apparatus according to the present invention includes: a refrigeration cycle that connects a compressor that pressurizes the refrigerant, a refrigerant flow path switching apparatus that switches the circulation path of the refrigerant, a heat source side heat exchanger that makes the refrigerant perform heat exchange, an expansion valve that adjusts the pressure of the refrigerant, and an intermediate heat exchanger that exchanges heat between the refrigerant and a heat medium different from the refrigerant, by piping; and a heat medium circulation circuit that connects the intermediate heat exchanger, a pump that makes, the heat medium related to heat exchange of the intermediate heat exchanger circulate, and the use side heat exchangers that exchange heat between the heat medium and the air related to the space subjected to air-conditioning, by piping. The heat source apparatus that is installed outside of a room of a building having two or more floors or in a space connected to the outside of the room and that accommodates a compressor, a refrigerant flow path switching apparatus, and a heat source side heat exchanger, and a relay unit that is provided in a non-subjected space which is different from a space subjected to air-conditioning, that is installed on a floor separated by two or more floors from the heat source apparatus and that accommodates expansion valves, pumps, and intermediate heat exchangers are connected by two pipelines across two or more floors. The relay unit and an indoor unit that accommodates a use side heat exchanger and is installed at a position where the air-conditioning subjected space can be air-conditioned are connected by two pipelines from outside of a wall which partitions the indoor and outdoor of the air-conditioning subjected space.

Advantageous Effects of Invention

According to the present invention, in the indoor unit for heating or cooling the air in the air-conditioning subjected space, the heat medium which is different from the refrigerant circulates and no refrigerant circulates. Therefore, even if the refrigerant leaks from pipelines and the like, for example, ingress of the refrigerant into the space subjected to air-conditioning can be suppressed, resulting in a safe air-conditioner apparatus. A relay unit is provided as a separate unit from the outdoor unit and the indoor unit. Therefore, the carrying power of the heat medium is less than the case where the heat medium is directly made to circulate between the heat source apparatus and the indoor unit, achieving energy saving. By providing the relay unit as a separate unit from the heat source apparatus and the indoor unit, the relay unit can be installed at a position near a pipe shaft and the like through which the pipelines of the refrigerant and the heat medium are fed, achieving easy construction. Further, since two pipelines connecting between the heat source apparatus and the relay unit and between the indoor unit and the relay unit can supply heating energy or cooling energy to the indoor unit, installation work becomes easier than a system supplying heating energy or cooling energy with four pipelines or a system whose refrigerant side is made of three pipelines.

REFERENCE SIGNS LIST

Figure 1:
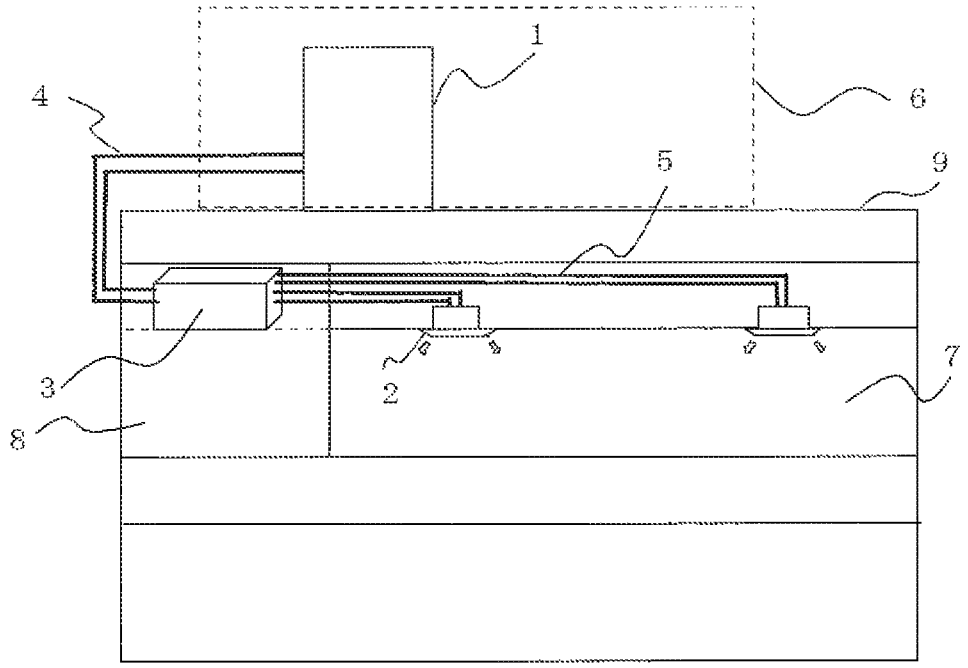
FIG. 1 is a diagram showing an example of installation of an air-conditioner apparatus according to an embodiment of the present invention.

1 heat source apparatus (outdoor unit)
2, 2*a*, 2*b*, ac, ad indoor unit
3 relay unit
3*a* main relay unit
3*b*(1), 3*b*(2) sub relay unit
4 refrigerant pipeline
5, 5*a*, 5*b*, 5*c*, 5*d* heat medium pipeline
6 outdoor space
7 indoor space
8 non-air conditioned space
9 building
10 compressor
11 four-way valve
12 heat source side heat exchanger
13*a*, 13*b*, 13*c*, 13*d* check valve
14 gas-liquid separator
15*a*, 15*b* intermediate heat exchanger
16*a*, 16*b*, 16*c*, 16*d*, 16*e* expansion valve
17 accumulator
21*a*, 21*b*, pump (heat medium feeding-out apparatus)
22*a*, 22*b*, 22*c*, 22*d* flow path switching valve
23*a*, 23*b*, 23*c*, 23*d* flow path switching valve
24*a*, 24*b*, 24*c*, 24*d* stop valve
25*a*, 25*b*, 25*c*, 25*d* flow amount adjustment valve
26*a*, 26*b*, 26*c*, 26*d* use side heat exchanger
31*a*, 31*b* first temperature sensor
32*a*, 32*b* second temperature sensor
33*a*, 33*b*, 33*c*, 33*d* third temperature sensor
34*a*, 34*b*, 34*c*, 34*d* fourth temperature sensor
35 fifth temperature sensor
36 pressure sensor
37 sixth temperature sensor
38 seventh temperature sensor
50 air purge apparatus
51 container
52 air purge valve
53 float
60 pressure buffer apparatus
61 container
62 buffer partition
100 outdoor unit side controller
200 signal line
300 relay unit side controller Embodiment 1

FIG. 1 is a diagram showing an example of installation of an air-conditioner apparatus according to an embodiment of the present invention. The air-conditioner apparatus of FIG. 1 includes an outdoor unit 1, which is a heat source apparatus, one or a plurality of indoor units 2 performing air-conditioning of a space to be air-conditioned, and a relay unit 3 that performs heat exchange between a refrigerant and a medium (hereinafter, referred to as a heat medium) which is different from the refrigerant and carries heat to relay heat transmission, as separate units respectively. The outdoor unit 1 and the relay unit 3 are connected by refrigerant pipelines 4 so as to allow a refrigerant such as a pseudo-azeotropic mixture refrigerant such as R-410A and R-404A to circulate and transfer heat amount. On the other hand, the relay unit 3 and the indoor unit 2 are connected by heat medium pipelines 5 so as to allow the heat medium such as plain water, water to which a preservative non-volatile or low-volatile within the air-conditioning temperature range is added, and an anti-freezing liquid to circulate in order to transfer heat.

Here, in the present embodiment, the outdoor unit 1 is disposed in the outdoor space 6, which is a space outside the buildings 9. The indoor unit 2 is disposed at a location where the air in the indoor space 7, which is a space to be air-conditioned such as a living room in the building 9, can be heated or cooled. The relay unit 3 where the refrigerant flows in and flows out is disposed in a non-air conditioned space 8 inside the building which is different from the outdoor space 6 and the indoor space 7. In order to minimize bad influence (such as a sense of discomfort) of the refrigerant on people caused by, for example, the occurrence of refrigerant leakage and the like, the non-air conditioned space 8 is made to be a space having no or few visitors. In FIG. 1, in the non-air conditioned space 8 such as a space in the ceiling partitioned from the indoor space 7 by walls, the relay unit 3 is disposed. The relay unit 3 may be disposed in, for example, a common use space where an elevator is installed as the non-air conditioned space 8.

It is configured that the outdoor unit 1 and the relay unit 3 of the present embodiment can be connected using two refrigerant pipelines 4. It is also configured that the relay unit 3 and each indoor unit 2 can be connected using two heat-medium pipelines 5 respectively. Such connection configuration allows, for example, two refrigerant pipelines 4 to pass through a wall of the building 9, facilitating the construction of the air-conditioner apparatus to the building 9.

Figure 2:
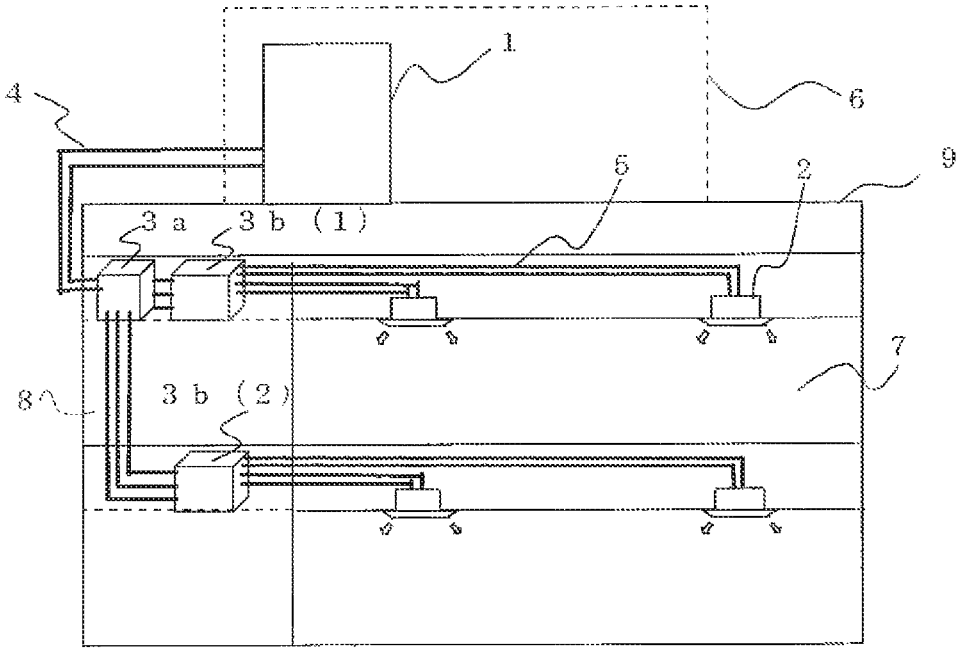
FIG. 2 is a diagram showing another example of installation of an air-conditioner apparatus.

FIG. 2 is a diagram showing another example of installation of the air-conditioner apparatus. In FIG. 2, the relay unit 3 is configured to be divided further into a main relay unit 3*a* and a plurality of sub relay units 3*b*(1) and 3*b*(2). Although details of the configuration will be mentioned later, by dividing the relay unit 3 into the main relay unit 3*a* and the sub relay units 3*b*, a plurality of sub relay units 3*b* can be connected with one main relay unit 3*a*. In the configuration of the present embodiment, there are three pipelines connecting between the main relay unit 3*a* and each sub relay unit 3*b*.

Here, although examples are shown in FIGS. 1 and 2 in which the indoor unit 2 is made to be a ceiling cassette type, it is not limited thereto. For example, any type such as a ceiling-concealed type and a ceiling-suspended type may be allowable as long as heated or cooled air can be supplied into the indoor space 7, directly, through a duct or the like.

The outdoor unit 1 has been explained with the case of being disposed in the outdoor space 6 outside the building 9 as an example. However, it is not limited thereto. For example, it may be disposed in a surrounded space like a machine room with a ventilating opening. The outdoor unit 1 may be disposed inside the building 9 and air may be exhausted to outside of the building 9 through an exhaust duct. Alternatively, using a water-cooled type heat source apparatus, the outdoor unit 1 may be disposed in the building 9.

Further, the relay unit 3 may be disposed near the heat source apparatus 1, though it may be against energy-saving.

Figure 3:
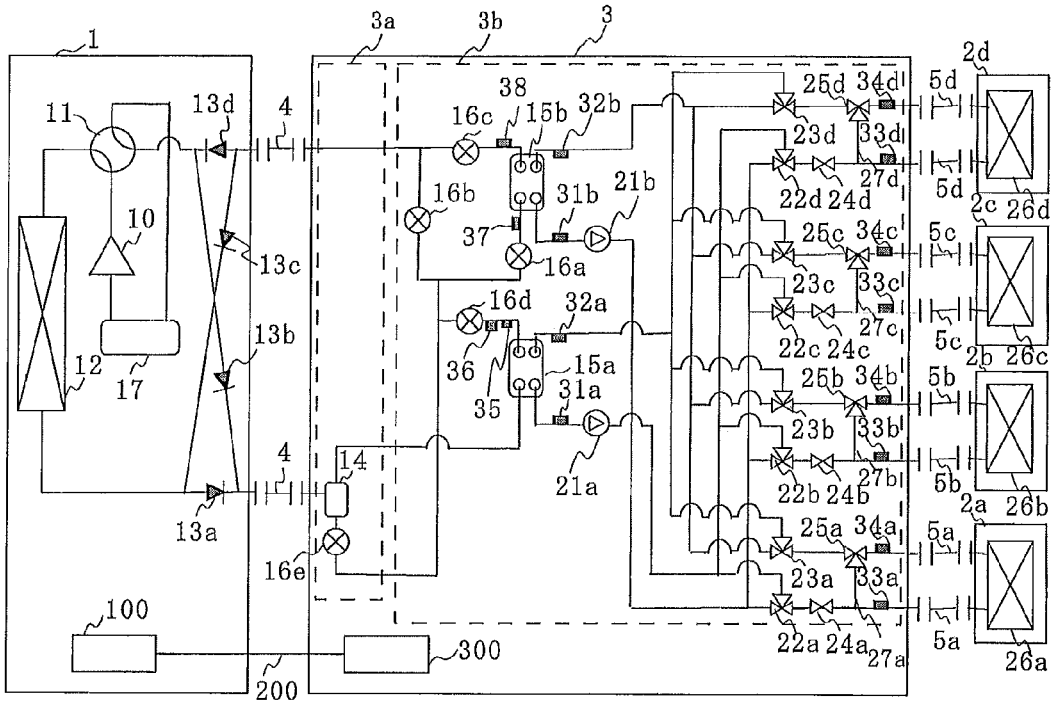
FIG. 3 is a diagram showing the configuration of an air-conditioner apparatus according to Embodiment 1.

FIG. 3 is a diagram illustrating the configuration of an air-conditioner apparatus according to Embodiment 1. The air-conditioner apparatus of the present embodiment has a refrigeration cycle apparatus configuring a refrigeration cycle (a refrigeration circulation circuit, a primary side circuit) by connecting a compressor 10, refrigerant flow path switching means 11, a heat source side heat exchanger 12, check valves 13*a*, 13*b*, 13*c*, and 13*d*, a gas-liquid separator 14*a*, intermediate heat exchangers 15*a* and 15*b*, electronic expansion valves 16*a*, 16*b*, 16*c*, 16*d*, and 16*e*, and an accumulator 17, by piping.

The compressor 10 pressurizes the sucked refrigerant to discharge (send out) it. The four-way valve 11, which functions as a refrigerant flow path switching apparatus, switches valves corresponding to an operation form (mode) related to cooling and heating based on the instructions of the outdoor unit side controller 100 to switch the refrigerant flow path. In the present embodiment, the circulation path is made to be switched according to the time of cooling only operation (an operation in which all indoor units 2 in operation perform cooling (including dehumidifying, hereinafter the same)) and cooling-main operation (an operation in which cooling becomes dominant when indoor units 2 performing cooling and heating operations simultaneously exist), and the time of heating only operation (an operation in which all indoor units 2 in operation perform heating) and heating-main operation (an operation in which heating becomes dominant when indoor units 2 performing cooling and heating operations simultaneously exist).

The heat source side heat exchanger 12 has a heat-transfer tube that feeds the refrigerant and fins (not shown) that enlarges a heat-transfer area between the refrigerant flowing through the heat-transfer tube and the outside air to exchange heat between the refrigerant and the air (outside air). For example, in heating only operation and heating-main operation, the heat source side heat exchanger 12 operates as an evaporator to evaporate and gasify the refrigerant. On the other hand, in cooling only operation and cooling-main operation, the heat source side heat exchanger 12 operates as a condenser or gas cooler (hereinafter, referred to as a condenser). In some case, the refrigerant is not completely gasified or liquefied but condensed into the two-phase mixture (gas-liquid two-phase refrigerant) state of the liquid and gas.

Check valves 13*a*, 13*b*, 13*c*, and 13*d* prevent the refrigerant from flowing back to adjust the refrigerant flow and keep a circulation path of the refrigerant flowing into and out of the outdoor unit 1 constant. The gas-liquid separator 14 separates the refrigerant flowing from the refrigerant pipeline 4 into a gasified refrigerant (gas refrigerant) and a liquefied refrigerant (liquid refrigerant). The intermediate heat exchangers 15*a* and 15*b* have a heat-transfer tube for feeding the refrigerant and another heat-transfer tube for feeding the heat medium to perform heat exchange between the refrigerant and the heat medium. In the present embodiment, the intermediate heat exchanger 15*a* functions as a condenser or a gas cooler in heating only operation, cooling-main operation, and heating-main operation in order to make the refrigerant release heat and heat the heat medium. The intermediate heat exchanger 15*b* functions as an evaporator in cooling only operation, cooling-main operation, and heating-main operation to make the refrigerant adsorb heat and cool the heat medium. For example, expansion valves 16*a*, 16*b*, 16*c*, 16*d*, and 16*e* such as electronic expansion valves decompress the refrigerant by adjusting the refrigerant flow amount. The accumulator 17 has operation of storing a surplus refrigerant in the refrigeration cycle and preventing the compressor 10 from being damaged by a great amount of the refrigerant liquid returning to the compressor 10.

Further, in FIG. 3, a heat medium side apparatus is provided in which the above-mentioned intermediate heat exchangers 15*a* and 15*b*, heat medium feeding-out means 21*a* and 21*b*, flow path switching valves 22*a*, 22*b*, 22*c*, 22*d*, 23*a*, 23*b*, 23*c*, and 23*d*, stop valves 24*a*, 24*b*, 24*c*, and 24*d*, flow amount adjustment valves 25*a*, 25*b*, 25*c*, and 25*d*, use side heat exchangers 26*a*, 26*b*, 26*c*, and 26*d*, and heat medium bypass pipelines 27*a*, 27*b*, 27*c*, and 27*d* are connected by piping to configure a heat medium circulation circuit (a secondary side circuit).

The pumps 21*a* and 21*b*, which are a heat medium feeding-out apparatus, pressurize the heat medium to let the same circulate. Here, regarding pumps 21*a* and 21*b*, a flow amount (discharged flow amount) to send out the heat medium can be changed by making the rotation speed of a built-in motor (not shown) vary within a certain range. In the indoor units 2*a*, 2*b*, 2*c*, and 2*d*, the use side heat exchangers 26*a*, 26*b*, 26*c*, and 26*d* respectively perform heat exchange between the heat medium and the air to be supplied into the indoor space 7 to heat or cool the air to be fed into the indoor space 7. Further, the flow path switching valves 22*a*, 22*b*, 22*c*, and 22*d*, which are, for example, three-way switching valves and the like, switch a flow path at the inlet side (heat medium flow-in side) of the use side heat exchangers 26*a*, 26*b*, 26*c*, and 26*d*, respectively. The flow path switching valves 23*a*, 23*b*, 23*c*, and 23*d* switch respective flow paths at the outlet side (heat medium flow-out side) of the use side heat exchangers 26*a*, 26*b*, 26*c*, and 26*d*, as well. Here, these switching apparatuses perform switching in order to let either of the heat medium related to heating or the heat medium related to cooling pass through the use side heat exchangers 26*a*, 26*b*, 26*c*, and 26*d*. Further, the stop valves 24*a*, 24*b*, 24*c*, and 24*d* are opened/closed based on the instructions from the relay unit controller 300 in order to make the heat medium pass through or be shut off from the use side heat exchangers 26*a*, 26*b*, 26*c*, and 26*d*.

Furthermore, the flow amount adjustment valves 25*a*, 25*b*, 25*c*, and 25*d*, which are three-way flow amount adjustment valves, adjust the ratio of the heat medium passing through the use side heat exchangers 26*a*, 26*b*, 26*c*, and 26*d* and heat medium bypass pipelines 27*a*, 27*b*, 27*c*, and 27*d* respectively, based on the instructions from the relay unit side controller 300. The heat medium bypass pipelines 27*a*, 27*b*, 27*c*, and 27*d* allow the heat medium that has not flowed through the use side heat exchangers 26*a*, 26*b*, 26*c*, and 26*d* due to the adjustment by the flow amount adjustment valves 25*a*, 25*b*, 25*c*, and 25*d* to pass therethrough respectively.

First temperature sensors 31*a* and 31*b* are temperature sensors to detect the temperature of the heat medium at the heat medium outlet side (heat medium flow-out side) of the respective intermediate heat exchangers 15*a* and 15*b*. Further, second temperature sensors 32*a* and 32*b* are temperature sensors to detect the temperature of the heat medium at the heat medium inlet side (heat medium flow-in side) of the respective intermediate heat exchangers 15*a* and 15*b*. Third temperature sensors 33*a*, 33*b*, 33*c*, and 33*d* are temperature sensors to detect the temperature of the heat medium at the inlet side (flow-in side) of the respective use side heat exchangers 26*a*, 26*b*, 26*c*, and 26*d*. Fourth temperature sensor 34*a*, 34*b*, 34*c*, and 34*d* are temperature sensors to detect the temperature of the heat medium at the outlet side (flow-out side) of the respective use side heat exchangers 26*a*, 26*b*, 26*c*, and 26*d*. Hereinafter, for example, as to the same means such as the fourth temperature sensors 34*a*, 34*b*, 34*c*, and 34*d*, subscripts will be omitted for example or the notation will be the fourth temperature sensors 34*a* to 34*d* when they need not be distinguished in particular. Other apparatuses and means will be the same.

Fifth temperature sensor 35 is a temperature sensor to detect the refrigerant temperature at the refrigerant outlet side (refrigerant flow-out side) of the intermediate heat exchanger 15*a*. Pressure sensor 36 is a pressure sensor to detect the refrigerant pressure at the refrigerant outlet side (refrigerant flow-out side) of the intermediate heat exchanger 15*a*. Sixth temperature sensor 37 is a temperature sensor to detect the refrigerant temperature at the refrigerant inlet side (refrigerant flow-in side) of the intermediate heat exchanger 15*b*. Seventh temperature sensor 38 is a temperature sensor to detect the refrigerant temperature at the refrigerant outlet side (refrigerant flow-out side) of the intermediate heat exchanger 15*b*. From the above-mentioned temperature detection means and pressure detection means, signals related to detected temperature values and pressure values are transmitted to the relay unit controller 300.

In the present embodiment, at least the outdoor unit 1 and the relay unit 3 include the outdoor unit side controller 100 and the relay unit side controller 300, respectively. The outdoor unit side controller 100 and the relay unit side controller 300 are connected by signal lines 200 to perform signal communication including various data. Here, the signal lines 200 may be wireless. The outdoor unit side controller 100 performs processing to perform control such as to transmit signals related to the commands to each apparatus accommodated especially in the outdoor unit 1 of the refrigeration cycle apparatus. Therefore, a storage device (not shown) is provided that stores various data and programs necessary for processing data related to the detection of various detection means or the like temporarily or for a long time. In the present embodiment, control target data that become a reference to control the condensing temperature and cooling temperature in the refrigeration cycle apparatus are stored. Further, the relay unit side controller 300 performs processing to perform control such as transmission of signals related to the commands to each device accommodated in the relay unit 3 such as a device of the heat medium circulation circuit. Here, in particular, control target values or their adjustment values are determined, and signals including the data are transmitted to the outdoor unit side controller 100. The relay unit side controller 300 is taken to have the storage device (not shown) as well. Although, the outdoor unit side controller 100 and the relay unit side controller 300 are adapted to be installed inside the outdoor unit 1 and the relay unit 3 respectively in FIG. 3, it is not limited thereto.

In the present embodiment, the compressor 10, the four-way valve 11, the heat source side heat exchanger 12, the check valves 13*a* to 13*d*, the accumulator 17, and the indoor unit side controller 100 are accommodated in the outdoor unit 1. Each use side heat exchanger 26*a* to 26*d* is accommodated in each indoor unit 2*a* to 2*d*, respectively.

In the present embodiment, among devices related to the heat medium circulation circuit and the refrigeration cycle apparatus, the gas-liquid separator 14 and the expansion valves 16*a* to 16*e* are accommodated in the relay unit 3. The first temperature sensors 31*a* and 31*b*, the second temperature sensors 32*a* and 32*b*, the third temperature sensors 33*a* to 33*d*, the fourth temperature sensors 34*a* to 34*d*, the fifth temperature sensor 35, the pressure sensor 36, the sixth temperature sensor 37, and the seventh temperature sensor 38 are accommodated in the relay unit 3, too.

Here, in a case where the main relay unit 3*a* and one or a plurality of the sub relay units 3*b* are installed separately as shown in FIG. 2, the gas-liquid separator 14 and the expansion valve 16*e* are accommodated in the main relay unit 3*a* as shown by the dotted line in FIG. 3, for example. The intermediate heat exchangers 15*a* and 15*b*, the expansion valves 16*a* to 16*d*, the pumps 21*a* and 21*b*, the flow path switching valves 22*a* to 22*d* and 23*a* to 23*d*, the stop valves 24*a* to 24*d*, and the flow amount adjustment valve 25*a* to 25*d* are accommodated in the relay unit 3*b*.

Next, descriptions will be given to operations of the air-conditioner apparatus in each operation mode based on the refrigerant and heat medium flow. Here, the pressure in the refrigeration cycle is not determined by the relation to the standard pressure but it is represented by high or low pressures as a relative pressure generated by the compression of the compressor 1 and the refrigerant flow amount control of the expansion valves 16*a* to 16*e*. It is assumed to be the same for the temperature.

Cooling Only Operation

Figure 4:
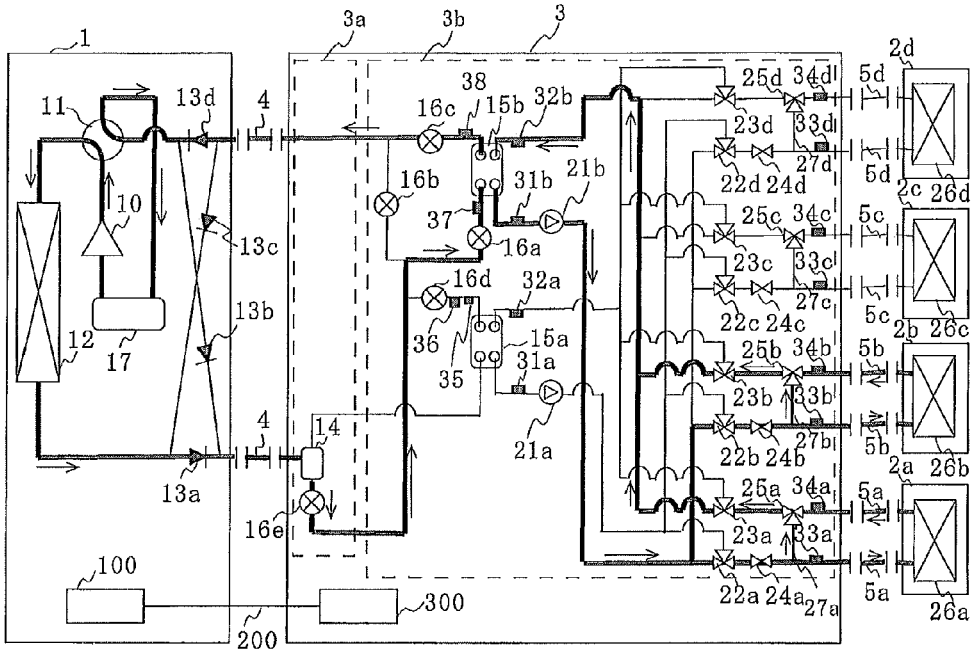
FIG. 4 is a diagram showing a refrigerant and heat medium flow at the time of cooling only operation.

FIG. 4 is a diagram showing the flow of a refrigerant and a heat medium flow at the time of cooling only operation respectively. Here, descriptions will be given to a case where the indoor units 2*a* and 2*b* perform cooling of the objective indoor space 7 respectively and the indoor units 2*c* and 2*d* are stopped. Firstly, the refrigerant flow in the refrigeration cycle will be explained. In the outdoor unit 1, the refrigerant sucked into the compressor 10 is compressed and discharged as a high-temperature gas refrigerant. The refrigerant having flowed out of the compressor 10 flows into the heat source side heat exchanger 12 that functions as a condenser through the four-way valve 11. The high-pressure gas refrigerant is condensed by exchanging heat with the outside air while passing through the heat source side heat exchange 12 to turn into a high-pressure liquid refrigerant and flows through the check valve 13*a* (does not flow through the check valves 13*b* and 13*c* side because of the refrigerant pressure), then flowing into the relay unit 3 via the refrigerant piping 4.

The refrigerant having flowed into the relay unit 3 passes through the gas-liquid separator 14. At the time of cooling only operation, since the liquid refrigerant flows into the relay unit 3, no gas refrigerant flows in the intermediate heat exchanger 15*a* and the intermediate heat exchanger 15*a* does not function. On the other hand, the liquid refrigerant passes through the expansion valves 16*e* and 16*a* to flow into the intermediate heat exchanger 15*b*. Here, since the relay unit side controller 300 controls the opening-degree of the expansion valve 16*a* to decompress the refrigerant by adjusting the flow amount of the refrigerant, the low-temperature low-pressure gas-liquid two-phase refrigerant flows into the intermediate heat exchanger 15*b*.

Since the intermediate heat exchanger 15*b* acts as an evaporator to the refrigerant, the refrigerant passing through the intermediate heat exchanger 15*b* turns into a low-temperature low-pressure gas refrigerant and flows out while cooling the heat medium as an heat exchange object (while absorbing heat from the heat medium). The gas refrigerant having flowed out from the intermediate heat exchanger 15*b* passes through the expansion valve 16*c* to flow out from the relay unit 3. Then, it passes through refrigerant pipeline 4 to flow into the outdoor unit 1. Here, at the time of cooling only operation, the expansion valves 16*b* and 16*d* are made to have opening-degree with which no refrigerant flows, based on the instructions from the relay unit side controller 300. The expansion valves 16*c* and 16*e* are made to be full open based on the instructions from the relay unit side controller 300 in order that no pressure loss may be generated.

The refrigerant flowed into the outdoor unit 1 passes through the check valve 13*d* to be sucked into the compressor 10 again via the four-way valve 11 and the accumulator 17.

Next, descriptions will be given to the heat medium flow in the heat medium circulation circuit. Here, in FIG. 4, it is not necessary to make the heat medium pass through the use side heat exchanger 26*c* and 26*d* of the indoor units 2*c* and 2*d* where there is no need to transfer heat because of the stop. (The indoor space 7 needn't be cooled. A state of being thermo-off is included.) Then, based on the instructions from the relay unit side controller 300, the stop valves 24*c* and 24*d* are closed so that no heat medium is made to flow into the use side heat exchangers 26*c* and 26*d*.

The heat medium is cooled by the heat exchange with the refrigerant in the intermediate heat exchanger 15*b*. Then, the cooled heat medium is sucked by the pump 21*b* to be sent out. The heat medium having flowed out of the pump 21*b* passes through the flow path switching valves 22*a* and 22*b* and the stop valves 24*a* and 24*b*. Then, through flow amount adjustment by the flow amount adjustment valves 25*a* and 25*b* based on the instructions from the relay unit side controller 300, the heat medium that covers (supplies) the necessary heat amount for the air-conditioning load to cool the air in the indoor space 7 flows into the use side heat exchangers 26*a* and 26*b*. Here, the relay unit side controller 300 makes the flow amount adjustment valves 25*a* and 25*b* adjust the ratio of the heat medium passing through the use side heat exchangers 26*a* and 26*b* and the heat medium bypass pipelines 27*a* and 27*b* so as to make the use side heat exchanger outlet/inlet temperature difference between the temperature related to the detection of the third temperature sensors 33*a* and 33*b* and the temperature related to the detection of the fourth temperature sensors 34*a* and 34*b* approach a set control target value.

The heat medium having flowed into the use side heat exchangers 26*a* and 26*b* exchanges heat with the air in the indoor space 7 and flows out. On the other hand, the remaining heat medium that has not flowed into the use side heat exchangers 26*a* and 26*b* passes through the heat medium bypass pipelines 27*a* and 27*b* with no contribution to air-conditioning in the indoor space 7.

The heat medium having flowed out of the use side heat exchangers 26*a* and 26*b* and the heat medium having passed through the heat medium bypass pipelines 27*a* and 27*b* meet at the flow amount adjustment valves 25*a* and 25*b* and pass through the flow path switching valves 23*a* and 23*b* to flow into the intermediate heat exchanger 15*b*. The heat medium cooled in the intermediate heat exchanger 15*b* is sucked by the pump 21*b* again to be sent out.

Heating Only Operation

Figure 5:
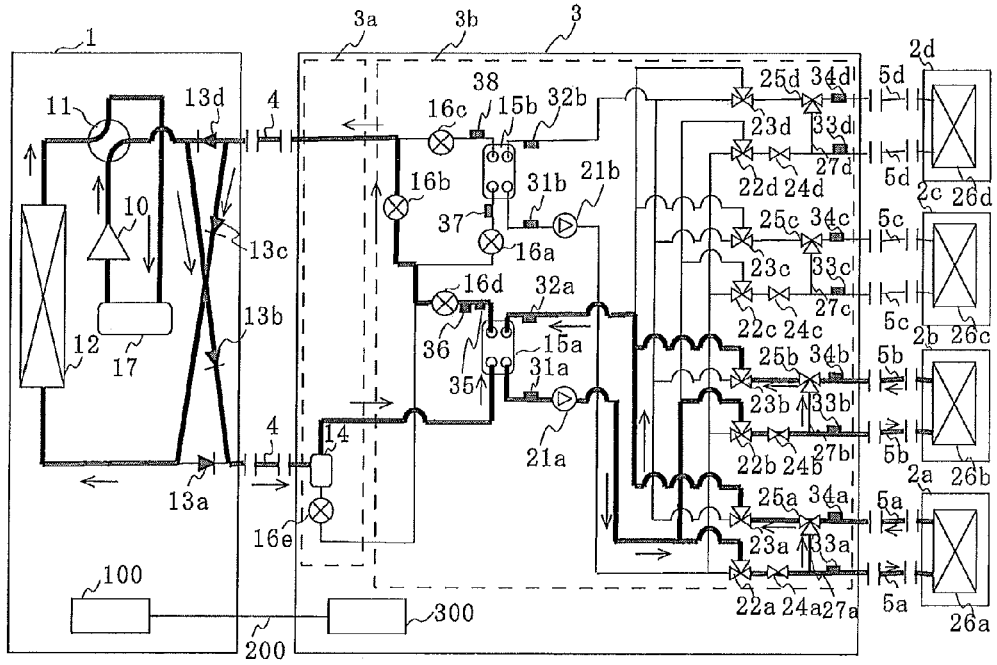
FIG. 5 is a diagram showing the refrigerant and heat medium flow at the time of heating only operation.

FIG. 5 is a diagram showing the refrigerant and the heat medium flow at the time of: heating only operation respectively. Here, descriptions will be given to a case where the indoor units 2*a* and 2*b* perform heating and the indoor units 2*c* and 2*d* are stopped. Firstly, the refrigerant flow in the refrigeration cycle will be explained. In the outdoor unit 1, the refrigerant sucked into the compressor 10 is compressed and discharged as a high-temperature gas refrigerant. The refrigerant having flowed out of the compressor 10 flows through the four-way valve 11 and the check valve 13*b*. Further, it flows into the relay unit 3 via the refrigerant pipeline 4.

The gas refrigerant having flowed into the relay unit 3 passes through the gas-liquid separator 14 to flow into the intermediate heat exchanger 15*a*. Since the intermediate heat exchanger 15*a* functions as a condenser for the refrigerant, the refrigerant passing through the intermediate heat exchanger 15*a* turns into a liquid refrigerant and flows out while heating the heat medium as an heat exchange object (while releasing heat to the heat medium).

The refrigerant having flowed out from the intermediate heat exchanger 15*a* passes through the expansion valves 16*d* and 16*e*, flows out of the relay unit 3, and flows into the outdoor unit 1 via the refrigerant pipeline 4. Then, since the relay unit side controller 300 adjusts the refrigerant flow amount by controlling the opening-degree of the expansion valve 16*b* or 16*d* to decompress the refrigerant, a low-temperature low-pressure gas-liquid two-phase refrigerant flows out from the relay unit 3. Here, at the time of heating only operation, the expansion valves 16*a* or 16*c*, and 16*e* are made to have opening-degree such that no refrigerant flows based on the instructions from the relay unit side controller 300.

The refrigerant having flowed into the outdoor unit 1 flows into the heat source side heat exchanger 12 that functions as an evaporator via the check valve 13*c*. The low-temperature low-pressure gas-liquid two-phase refrigerant evaporates through the heat exchange with the air while passing through the heat source side heat exchanger 12 and turns into a low-temperature low-pressure gas refrigerant. The refrigerant having flowed out from the heat source side heat exchanger 12 is sucked into the compressor 10 again via the four-way valve 11 and the accumulator 17.

Next, descriptions will be given to the heat medium flow in the heat medium circulation circuit. Here, in FIG. 5, there is no need to make the heat medium to pass through the use side heat exchangers 26*c* and 26*d* of the indoor units 2*c* and 2*d* to which no air-conditioning load is required to be transferred because of the stop. (The indoor space 7 needn't be cooled. A state of the thermo-off is included.) Then, based on the instructions from the relay unit side controller 300, the stop valves 29*c* and 29*d* are closed so that no heat medium flows through the use side heat exchangers 26*c* and 26*d*.

The heat medium is heated by exchanging heat with the refrigerant in the intermediate heat exchanger 15*a*. The heated heat medium is sucked by the pump 21*a* to be sent out. The heat medium having flowed out from the pump 21*a* passes through the flow path switching valves 22*a* and 22*b* and stop valves 29*a* and 24*b*. Through the flow amount adjustment by the flow amount adjustment valves 25*a* and 25*b* based on the instructions from the relay unit side controller 300, the heat medium that covers (supplies) necessary heat for the work to heat the air in the indoor space 7 flows into the use side heat exchangers 26*a* and 26*b*. Here, in heating only operation, the relay unit side controller. 300 makes the flow amount adjustment valves 25*a* and 25*b* adjust the ratio of the heat medium passing through the use side heat exchangers 26*a* and 26*b* and the heat medium bypass pipelines 27*a* and 27*b* so that the temperature difference between the temperature related to the detection by the third temperature sensors 33*a* and 33*b* and the temperature related to the detection by the fourth temperature sensors 34*a* and 34*b* is made to be a set target value.

The heat medium having flowed into the use side heat exchangers 26*a* and 26*b* exchanges heat with the air in the indoor space 7 and flows out. On the other hand, the remaining heat medium that has not flowed into the use side heat exchangers 26*a* and 26*b* passes through the heat medium bypass pipelines 27*a* and 27*b* with no contribution to air-conditioning of the indoor space 7.

The heat medium having flowed out of the use side heat exchangers 26*a* and 26*b* and the heat medium having passed through the heat medium bypass pipelines 27*a* and 27*b* merge at the flow amount adjustment valves 25*a* and 25*b* and pass through the flow path switching valves 23*a* and 23*b* to flow into the intermediate heat exchanger 15*b*. The heat medium heated in the intermediate heat exchanger 15*b* is sucked by the pump 21*a* again to be sent out.

Cooling-Main Operation

Figure 6:
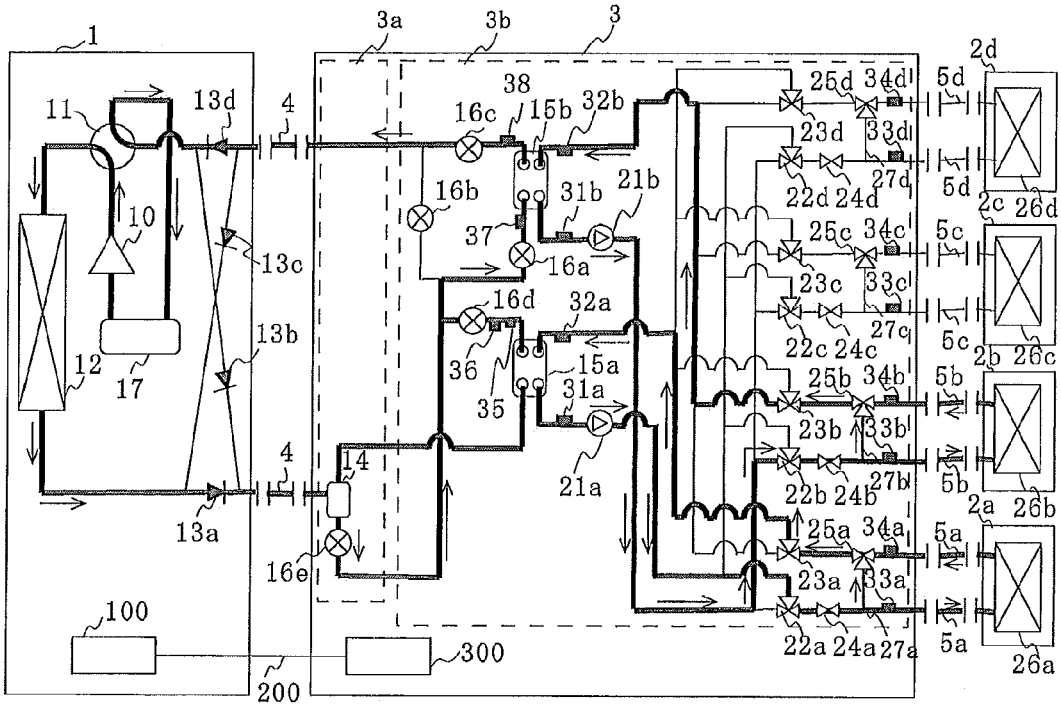
FIG. 6 is a diagram showing the refrigerant and heat medium flow at the time of cooling-main operation.

FIG. 6 is a diagram showing the refrigerant and heat medium flow at the time of cooling-main operation respectively. Here, descriptions will be given to a case where the indoor unit 2*a* performs heating, the indoor unit 2*b* performs cooling, and the indoor units 2*c* and 2*d* are stopped. Firstly, the refrigerant flow in the refrigeration cycle will be explained. In the outdoor unit 1, the refrigerant sucked into the compressor 10 is compressed and discharged as a high-temperature gas refrigerant. The refrigerant having flowed out from the compressor 10 flows into the heat source side heat exchanger 12 via the four-way valve 11. The high-pressure gas refrigerant is condensed by exchanging heat with the air while passing through the heat source side heat exchanger 12. Here, in the cooling-main operation, the gas-liquid two-phase refrigerant is adapted to flow out from the heat source side heat exchanger 12. The gas-liquid two-phase refrigerant having flowed out from the heat source side heat exchanger 12 flows through the check valve 13*a*. Then, it flows into the relay unit 3 via the refrigerant pipeline 4.

The refrigerant having flowed into the relay unit 3 passes through the gas-liquid separator 14. The gas-liquid two-phase refrigerant is separated into the liquid refrigerant and the gas refrigerant in the gas-liquid separator 14. The gas refrigerant separated in the gas-liquid separator 14 flows into the intermediate heat exchanger 15*a*. The refrigerant having flowed into the intermediate heat exchanger 15*a* turns into a liquid refrigerant while heating the heat medium as a heat-exchange object by condensation and flows out to pass through the expansion valve 16*d*.

On the other hand, the liquid refrigerant separated in the gas-liquid separator 14 passes through the expansion valve 16*e*, meets with the liquid refrigerant having passed through the expansion valve 16*d*, passes through the expansion valve 16*a* and flows into the intermediate heat exchanger 15*b*. Here, since the relay unit side controller 300 controls the opening-degree of the expansion valve 16*a* and adjust the refrigerant flow amount so as to decompress the refrigerant, a low-temperature low-pressure gas-liquid two-phase refrigerant flows into the intermediate heat exchanger 15*b*. The refrigerant having flowed into the intermediate heat exchanger 15*b* turns into a low-temperature low-pressure gas refrigerant while cooling the heat medium as a heat exchange object by evaporation and flows out. The gas refrigerant having flowed out from the intermediate heat exchanger 15*b* passes through the expansion valve 16*c* to flow out from the relay unit 3. And it passes through refrigerant pipeline 4 to flow into the outdoor unit 1. Here, at the time of cooling-main operation, the expansion valve 16*b* is made to have opening-degree such that no refrigerant flows based on the instructions from the relay unit side controller 300. The expansion valve 16*c* is made to be full open based on the instructions from the relay unit side controller 300 so that no pressure loss occurs.

The refrigerant having flowed into the outdoor unit 1 passes through the check valve 13*d* to be sucked into the compressor 10 again via the four-way valve 11 and the accumulator 17.

Next, descriptions will be given to the heat medium flow in the heat medium circulation circuit. Here, in FIG. 6, it is not necessary to make the heat medium pass through the use side heat exchangers 26*c* and 26*d* of the indoor units 2*c* and 2*d* subjected to no air-conditioning load because of the stop. (The indoor space 7 needn't be cooled or heated. A state of being thermo-off is included.) Then, based on the instructions from the relay unit side controller 300, the stop valves 24*c* and 24*d* are closed so that no heat medium flows into the use side heat exchangers 26*c* and 26*d*.

The heat medium is cooled by exchanging heat with the refrigerant in the intermediate heat exchanger 15*b*. Then, the cooled heat medium is sucked by the pump 21*b* to be sent out. In the meantime, the heat medium is heated by exchanging heat with the refrigerant in the intermediate heat exchanger 15*a*. Then, the heated heat medium is sucked by the pump 21*a* to be sent out.

The cooled heat medium having flowed out from the pump 21*b* passes through the flow path switching valve 22*b* and the stop valve 24*b*. The heated heat medium flowed out from the pump 21*a* passes through the flow path switching valve 22*a* and the stop valve 24*a*. Thus, the flow path switching valve 22*a* allows heated heat medium to pass and cooled heat medium to be shut off. The flow path switching valve 22*b* allows cooled heat medium to pass and heated heat medium to be shut off. Therefore, during the circulation, the flow paths in which the cooled heat medium and the heated heat medium flow are partitioned and separated, being never mixed as a result.

Through the flow amount adjustment by the flow amount adjustment valves 25*a* and 25*b* based on the instructions from the relay unit side controller 300, the heat medium that covers (supplies) the necessary heat for the work to cool or heat the air in the indoor space 7 flows into the use side heat exchangers 26*a* and 26*b*. Here, the relay unit side controller 300 makes the flow amount adjustment valves 25*a* and 25*b* adjust the ratio of the heat medium passing through the use side heat exchangers 26*a* and 26*b* and the heat medium bypass pipelines 27*a* and 27*b* so that the temperature differences between the temperatures related to the detection by the third temperature sensors 33*a* and 33*b* and the temperatures related to the detection by the fourth temperature sensors 34*a* and 34*b* are made to be a set target value respectively.

The heat medium having flowed into the use side heat exchangers 26*a* and 26*b* exchanges heat with the air in the indoor space 7 and flows out. On the other hand, the remaining heat medium that has not flowed into the use side heat exchangers 26*a* and 26*b* passes through the heat medium bypass pipelines 27*a* and 27*b* with no contribution to air-conditioning of the indoor space 7.

The heat medium having flowed out of the use side heat exchangers 26*a* and 26*b* and the heat medium having passed through the heat medium bypass pipelines 27*a* and 27*b* meet at the flow amount adjustment valves 25*a* and 25*b* and pass through the flow path switching valves 23*a* and 23*b* to flow into the intermediate heat exchanger 15*b*. The heat medium cooled in the intermediate heat exchanger 15*b* is sucked by the pump 21*b* again to be sent out. Similarly, the heat medium heated in the intermediate heat exchanger 15*a* is sucked by the pump 21*a* again to be sent out.

Heating-Main Operation

Figure 7:
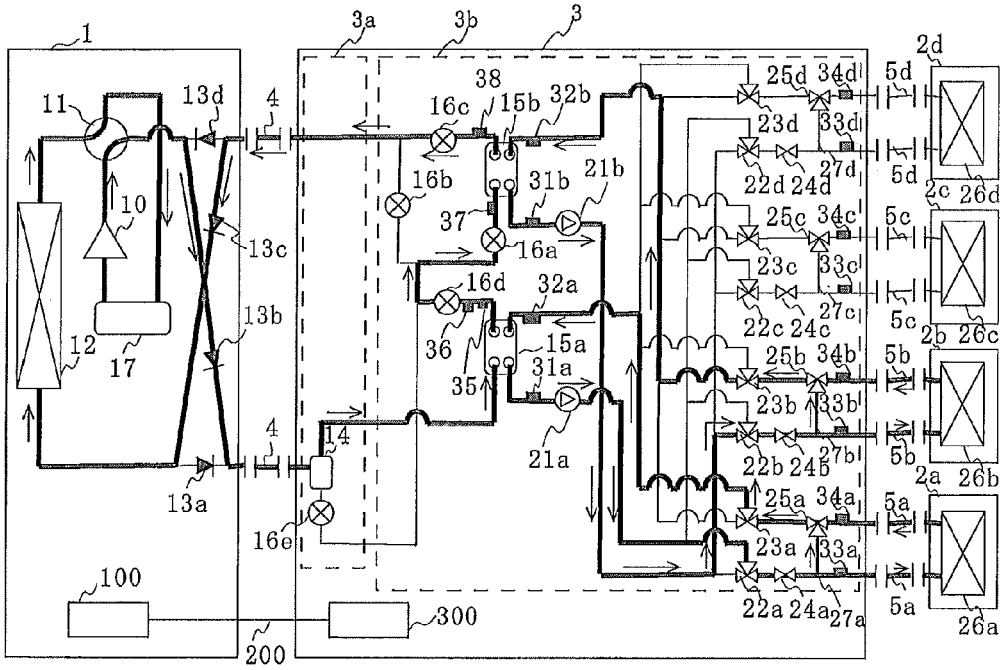
FIG. 7 is a diagram showing the refrigerant and heat medium flow at the time of heating-main operation.

FIG. 7 is a diagram showing the refrigerant and heat medium flow at the time of heating-main operation respectively. Here, descriptions will be given to a case where the indoor unit 2*a* performs heating, the indoor unit 2*b* performs cooling, and the indoor units 2*c* and 2*d* are stopped. Firstly, the refrigerant flow in the refrigeration cycle will be explained. In the outdoor unit 1, the refrigerant sucked into the compressor 10 is compressed and discharged as a high-temperature gas refrigerant. The refrigerant having flowed out of the compressor 10 flows through the four-way valve 11 and the check valve 13*b*. Further, it flows into the relay unit 3 via the refrigerant pipeline 4.

The refrigerant having flowed into the relay unit 3 passes through the gas-liquid separator 14. The gas refrigerant having passed through the gas-liquid separator 14 flows into the intermediate heat exchanger 15*a*. The refrigerant having flowed into the intermediate heat exchanger 15*a* turns into a liquid refrigerant while heating the heat medium as a heat-exchange object by condensation, flows out, and passes through the expansion valve 16*d*. Here, at the time of heating-main operation, the expansion valves 16*e* is made to have opening-degree such that no refrigerant flows based on the instructions from the relay unit side controller 300.

The refrigerant having passed the expansion valve 16*d* further passes through the expansion valves 16*a* and 16*b*. The refrigerant having passed through the expansion valve 16*a* flows into the intermediate heat exchanger 15*b*. Here, since the relay unit side controller 300 controls the opening-degree of the expansion valve 16*a* and adjusts the refrigerant flow amount so as to decompress the refrigerant, a low-temperature low-pressure gas-liquid two-phase refrigerant flows into the intermediate heat exchanger 15*b*. The refrigerant having flowed into the intermediate heat exchanger 15*b* turns into a low-temperature low-pressure gas refrigerant while cooling the heat medium as a heat exchange object by evaporation and flows out. The gas refrigerant having flowed out from the intermediate heat exchanger 15*b* passes through the expansion valve 16*c*. On the other hand, the refrigerant having passed the expansion valve 16*b* turns into a low-temperature low-pressure gas-liquid two-phase refrigerant as well because the relay unit side controller 300 controls the opening-degree of the expansion valve 16*a*, and meets with the gas refrigerant having passed the expansion valve 16*c*. Therefore, the refrigerant becomes a low-temperature low-pressure refrigerant having a larger dryness. The met refrigerant flows into the outdoor unit 1 via the refrigerant pipeline 4.

The refrigerant having flowed into the outdoor unit 1 flows into the heat source side heat exchanger 12 that functions as an evaporator via the check valve 13*c*. The low-temperature low-pressure gas-liquid two-phase refrigerant evaporates by exchanging heat with the air while passing through the heat source side heat exchanger 12 and turns into a low-temperature low-pressure gas refrigerant. The refrigerant having flowed out from the heat source side heat exchanger 12 is sucked into the compressor 10 again through the four-way valve 11 and the accumulator 17.

Next, descriptions will be given to the heat medium flow in the heat medium circulation circuit. Here, in FIG. 7, it is not necessary to make the heat medium pass through the use side heat exchangers 26*c* and 26*d* of the indoor units 2*c* and 2*d* to which no air-conditioning load is applied because of the stop. (The indoor space 7 needn't be cooled or heated. A state of being thermo-off is included.) Then, based on the instructions from the relay unit side controller 300, the stop valves 24*c* and 24*d* are closed so that no heat medium flows into the use side heat exchangers 26*c* and 26*d*.

The heat medium is cooled by exchanging heat with the refrigerant in the intermediate heat exchanger 15*b*. Then, the cooled heat medium is sucked by the pump 21*b* to be sent out. In the meantime, the heat medium is heated by exchanging heat with the refrigerant in the intermediate heat exchanger 15*a*. Then, the heated heat medium is sucked by the pump 21*a* to be sent out.

The cooled heat medium having flowed out from the pump 21*b* passes through the flow path switching valve 22*b* and the stop valve 24*b*. The heated heat medium having flowed out from the pump 21*a* passes through the flow path switching valve 22*a* and the stop valve 24*a*. Thus, the flow path switching valve 22*a* makes the heated heat medium pass through and shuts off the cooled heat medium. The flow path switching valve 22*b* makes the cooled heat medium pass through and shuts off the heated heat medium. Therefore, during the circulation, cooled heat medium and heated heat medium are separated, being never mixed as a result.

Through the flow amount adjustment by the flow amount adjustment valves 25*a* and 25*b* based on the instructions from the relay unit side controller 300, the heat medium that covers (supplies) the necessary heat for the work to heat or cool the air in the indoor space 7 flows into the use side heat exchangers 26*a* and 26*b*. Here, the relay unit side controller 300 makes the flow amount adjustment valves 25*a* and 25*b* adjust the ratio of the heat medium passing through the use side heat exchangers 26*a* and 26*b* and the heat medium bypass pipelines 27*a* and 27*b* so that the temperature differences between the temperatures related to the detection by the third temperature sensors 33*a* and 33*b* and the temperatures related to the detection by the fourth temperature sensors 34*a* and 34*b* are made to be a set target value respectively.

The heat medium having flowed into the use side heat exchangers 26*a* and 26*b* exchanges heat with the air in the indoor space 7 and flows out. On the other hand, the remaining heat medium that has not flowed into the use side heat exchangers 26*a* and 26*b* passes through the heat medium bypass pipelines 27*a* and 27*b* with no contribution to the air-conditioning of the indoor space 7.

The heat medium having flowed out of the use side heat exchangers 26*a* and 26*b* and the heat medium having passed through the heat medium bypass pipelines 27*a* and 27*b* meet at the flow amount adjustment valves 25*a* and 25*b* and pass through the flow path switching valves 23*a* and 23*b* to flow into the intermediate heat exchanger 15*b*. The heat medium cooled in the intermediate heat exchanger 15*b* is sucked by the pump 21*b* again to be sent out. Similarly, the heat medium heated in the intermediate heat exchanger 15*a* is sucked by the pump 21*a* again to be sent out.

Thus, the air-conditioner apparatus according to the present embodiment is configured to be able to separate the gas refrigerant and the liquid refrigerant by installing the gas-liquid separator 14 in the relay unit 3. Therefore, it is not necessary to supply the gas refrigerant and the liquid refrigerant from the outdoor unit 1 side to the relay unit 3 by independent pipelines respectively. Accordingly, a refrigeration cycle can be configured such that two refrigerant pipelines 4 connect between the outdoor unit 1 and the relay unit 3 and it is possible for a cooling operation and a heating operation to exist simultaneously and to perform their operations simultaneously by using the indoor unit 2.

In the relay unit 3 side, the flow path switching valves 22*a* to 22*d* and 23*a* to 23*d* and the stop valves 24*a* to 24*d* perform switching to open and close. Therefore, between the heated refrigerant and cooled refrigerant, required refrigerant is supplied or not supplied to the use side heat exchangers 26*a* to 26*d* of respective indoor units 2*a* to 2*d*, on the side of the relay unit 3. Accordingly, two heat medium pipelines 5 can connect between the relay unit 3 and the indoor units 2*a* to 2*d*.

Further, the outdoor unit 1, indoor unit 2, and relay unit 3 is configured as independent units and capable of being installed at different locations respectively. Consequently, regarding the outdoor unit 1 having a refrigeration cycle and the relay unit 3, it is possible to install the same in an outdoor space 6 and a space 8 which are different from the indoor space 7 where people reside so that the refrigerant does not have harmful effects when refrigerant leak should occur, for example.

Further, the outdoor unit 1 and the relay unit 3 may be installed at separated locations respectively as well. In general, since the heat medium such as water is filled as a liquid in the heat medium circulation circuit, power related to carrying the heat medium becomes larger than a case of carrying the refrigerant. Consequently, a shorter circulation path (pipeline) of the heat medium than the refrigerant path is desirable from the viewpoint of energy-saving. Then, by making the outdoor unit 1 and the relay unit 3 separate units, the intermediate heat exchangers 15*a* and 15*b* and the use side heat exchangers 26*a* to 26*d* can be made closer to each other to shorten the circulation path of the heat medium as long as the refrigerant does not have harmful effects as mentioned above. However, since the water pipeline and the refrigerant pipeline connected to each indoor unit are made to pass through pipe shafts installed at a common use part, work of construction would become easier if the relay unit 3 is installed at the common use part or the like which is located sufficiently apart from each indoor unit 2 and close to the pipe shafts, and the heat medium is made to branch. Moreover, since by two refrigerant pipelines and two heat medium pipelines for water or the like, hot water or cold water can be supplied to the indoor unit 2, construction efficiency is better than a four-pipeline type chiller.

As shown in FIGS. 1 and 2, by making the relay unit 3 or sub relay unit 3*b* installed at each floor, the heat medium circulation circuit is configured only in the same floor and the heat medium can circulate and be carried. Consequently, the circulation path pipeline length can be shortened and the carrying power can be made further smaller, permitting promotion of energy-saving. Further, the heat medium pipelines 5 between the relay unit 3 and the sub relay unit 3*b*, and the indoor unit 2 is of two-pipeline type, plumbing and construction will be done easily.

Here, in the intermediate heat exchanger 15*a* that heats the heat medium, the refrigerant releases heat to heat the heat medium. Therefore, the outlet side (flow-out side) temperature of the heat medium related to the detection by the first temperature sensor 31*a* does not exceed the refrigerant temperature at the inlet side (flow-in side) of the intermediate heat exchanger 15*a*. Since heating capacity in the superheat gas area of the refrigerant is small, the outlet side (flow-out side) temperature of the heat medium is restricted by a condensing temperature obtained by a saturation temperature at the pressure related to the detection by the pressure sensor 36. In the intermediate heat exchanger 15*b* that cools the heat medium, the refrigerant absorbs heat from the heat medium to cool it. Therefore, the outlet side (flow-out side) temperature of the heat medium related to the detection by the intermediate heat exchanger outlet heat medium temperature sensor 31*b* does not become lower than the refrigerant temperature at the inlet side (flow-in side) of the intermediate heat exchanger 15*b*.

Accordingly, in response to the increase or decrease in the air-conditioning load related to the heat exchange (heating or cooling) of the use side heat exchangers 26*a* to 26*d* (indoor units 2*a* to 2*d*), changing the condensing temperature and/or evaporating temperature in the refrigeration cycle side of the intermediate heat exchanger 15*a* and 15*b* makes the loss of the energy small and is effective. Then, according to the air-conditioning load of the use side, a control target value of the condensing temperature and/or evaporating temperature of the refrigerant in the intermediate heat exchangers 15*a* and 15*b* is changed and the condensing temperature and/or evaporating temperature are varied to adjust the control target value. It is possible to follow the change in the air-conditioning load by changing the condensing temperature and/or evaporating temperature.

The relay unit side controller 300 in the relay unit 3 side having each temperature detection means in the intermediate heat exchangers 15*a* and 15*b* and the heat medium circulation circuit can calculate and grasp the air-conditioning load in the use side (indoor unit 2 side). On the other hand, the outdoor unit side controller 100 in the outdoor unit side provided with the compressor 10 and the heat source side heat exchanger 12 sets the control target value related to the condensing temperature and evaporating temperature as data to control devices (devices in the outdoor unit 1, in particular) of the refrigeration cycle apparatus.

In order to make it possible to set a control target value based on the air-conditioning load, the outdoor unit side controller 100 and the relay unit side controller 300 are connected by a signal line 200 to permit transmission and reception of signals. Further, the relay unit side controller 300 transmits signals including the control target value data of the condensing temperature and/or evaporating temperature decided based on the air-conditioning load related to heating or cooling. The outdoor unit side controller 100 that has received signals changes the control target value of the condensing temperature and/or the evaporating temperature. Here, by transmitting signals including data of an adjustment value of the control target value from the relay unit side controller 300, the outdoor unit side controller 100 may change the control target value.

Thereby, in response to the air-conditioning load related to heating or cooling in the heat medium circulation circuit, the condensing temperature and/or evaporating temperature in the refrigeration cycle side of the intermediate heat exchangers 15*a* and 15*b* can be appropriately changed. For that purpose, when the air-conditioning load is reduced, for example, it is possible to lower the work load performed by the compressor 10 in the refrigeration cycle, allowing energy-saving to be promoted.

As mentioned above, in the air-conditioner apparatus of Embodiment 1, the heat medium circulates in the indoor unit 2 to heat or cool the air in the indoor space 7 and no refrigerant circulates therein. Therefore, a safe air-conditioner apparatus can be obtained such that, for example, if the refrigerant leaks from pipelines or the like, the refrigerant can be prevented from entering the indoor space 7 where people reside. By making the relay unit 3*a* separate unit from the outdoor unit 1 and the indoor unit 2, since the distance for carrying the heat medium becomes shorter than the case where the heat medium is made to circulate between the outdoor unit and the indoor unit directly, carrying power can be made small, resulting in energy-saving. In the air-conditioner apparatus of the present embodiment, operation can be performed by any of the four forms (modes), cooling only operation, heating only operation, cooling-main operation, and heating-main operation. In such operation forms, the relay unit 3 can have the intermediate heat exchangers 15*a* and 15*b* that heat and cool the heat medium respectively, and the heated heat medium and the cooled heat medium can be supplied to the use side heat exchangers 26*a* to 26*d* in need by the flow path switching valves 22*a* to 22*d* and 23*a* to 23*d* such as two-way switching valves and three-way switching valves. Consequently, only two pipelines are necessary to connect the outdoor unit 1 with the relay unit 3, and the indoor unit 2 with the relay unit 3, facilitating the installation work or the like.

Further, since signal transmission and reception are made possible by the signal line 200 between the outdoor unit side controller 100 that controls devices installed in the outdoor unit 1 and the relay unit side controller 300 that controls devices installed in the relay unit 3, it is possible to perform control in cooperation. In particular, since the relay unit side controller 300 reads data that can decide the air-conditioning load in the heat medium circulation circuit, the control target value of the condensing temperature and evaporating temperature in the refrigeration cycle side can be set based on the air-conditioning load and the outdoor unit side controller 100 can control each device based on the control target value. Consequently, the refrigeration cycle apparatus can be operated according to the air-conditioning load, permitting energy-saving.

Embodiment 2

In the above-mentioned Embodiment 1, although descriptions are given using a pseudo-azeotropic mixture refrigerant as the refrigerant to be made to circulate in the refrigeration cycle, it is not limited thereto. For example, a single refrigerant such as R-22 and R-134a, a pseudo-azeotropic mixture refrigerant such as R-407C, a refrigerant that is regarded to have a smaller global warming potential such as $CF_3CF{=}CH_2$ including a double bond in the chemical formula and its mixture including said refrigerant, and a natural refrigerant such as $CO_2$ and propane may be employed.

Further, in the air-conditioner apparatus according to the above-mentioned embodiment, the refrigeration cycle is configured to have an accumulator 17. However, a configuration having no accumulator 17 is possible. Since the check valves 13*a* to 13*d* are not indispensable means, the refrigeration cycle configured without them can perform the same operation and the same effect can be achieved.

Although it is not shown in the above-mentioned embodiment in particular, a fan may be provided in the outdoor unit 1 in order to promote heat exchange between the outside air and the refrigerant in the heat source side heat exchanger 12, for example. In each of the indoor units 2*a* to 2*d*, a fan may be provided in order to promote heat exchange between the air and the heat medium in each of the use side heat exchangers 26*a* to 26*d* to deliver heated or cooled air into the indoor space 7, as well. Further, in the above-mentioned embodiment, descriptions are given to providing a fan in order to promote heat exchange in each of the heat source side heat exchanger 12 and the use side heat exchanger 26*a* to 26*d*. However, it is not limited thereto. Any configuration may be available as long as it is configured by means and apparatuses that can promote heat release or heat absorption to the refrigerant and heat medium. For example, each of the use side heat exchangers 26*a* to 26*d* can be configured by a panel heater and the like utilizing radiation without providing a fan in particular. The heat exchange with the refrigerant in the heat source side heat exchanger 12 may be performed by water and an anti-freezing liquid.

In the above-mentioned embodiment, descriptions are given to a case where four indoor units 2 have the use side heat exchangers 26*a* to 26*d* respectively. However, the number of the indoor unit 2 is not limited to four.

Descriptions are given to a case where the flow path switching valves 22*a* to 22*d* and 23*a* to 23*d*, the stop valves 24*a* to 24*d*, and the flow amount adjustment valves 25*a* to 25*d* are connected with the use side heat exchangers 26*a* to 26*d* on a one-to-one basis respectively. However, it is not limited thereto. For example, each of the use side heat exchangers 26*a* to 26*d* may be provided with a plurality of the above-mentioned apparatus to be operated in the same way. Then, the flow path switching valves 22 and 23, the stop valves 24, and the flow amount adjustment valves 25 connected with the respective use side heat exchangers 26*a* to 26*d* may be made to operate in the same way.

Figure 8:
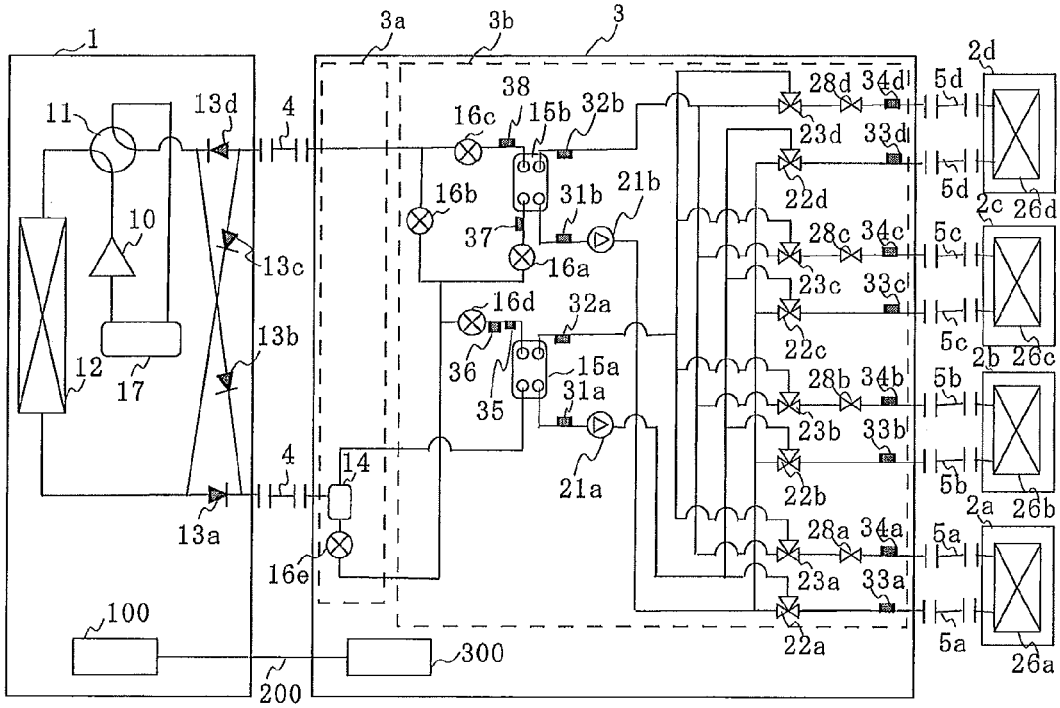
FIG. 8 is a diagram showing another example of the configuration of an air-conditioner apparatus according to Embodiment 2.

FIG. 8 is a diagram showing an example of another configuration of the air-conditioner apparatus. In FIG. 8, in place of the flow amount adjustment valves 25*a* to 25*d* and the stop valves 24*a* to 24*d*, solenoid valves and the two-way flow amount adjustment valves 28*a* to 28*d*, which are flow amount adjustment valves of a stepping motor type, are used. The two-way flow amount adjustment valves 28*a* to 28*d* adjust the heat medium flow amount flowing into/out of respective use side heat exchanger 26*a* to 26*d* based on the instructions from the heat medium heat exchanger controller 101. By making the opening-degree such that no refrigerant flows, the flow path to each of the use side heat exchangers 26*a* to 26*d* is closed. The two-way flow amount adjustment valves 28*a* to 28*d* serve as the flow amount adjustment valves 25*a* to 25*d* and the stop valves 24*a* to 24*d* in Embodiment 1, permitting reduction of the number of apparatus (valves) to achieve a low-cost configuration.

Although not shown in particular in the above-mentioned embodiment, the two-way flow amount adjustment valves 28*a* to 28*d* or the three-way flow path adjustment valves 25*a* to 25*d*, the third temperature sensors 33*a* to 33*d*, and the fourth temperature sensors 34*a* to 34*d* may be installed in the relay unit 3 or in the vicinity thereof. By installing in the relay unit 3 having the flow path switching valves 22*a* to 22*d* or in the vicinity thereof, apparatus and components related to the heat medium circulation can be gathered to a closer location in distance. Therefore, check and repair or the like can be easily done. On the other hand, the indoor units 2*a* to 2*d* may be provided with them in a similar configuration to electric expansion valves in conventional air-conditioner apparatus which precisely detect the temperature related to the use side heat exchangers 26*a* to 26*d* without being affected by the length of the heat medium pipelines 5, to improve controllability.

In the above-mentioned embodiment, descriptions are given to an example where one intermediate heat exchanger 15*a* for cooling the heat medium as an evaporator and one intermediate heat exchanger 15*b* for heating the heat medium as a condenser are provided, respectively. However, the present invention does not limit the number of each unit as one, but a plurality of units can be provided.

Embodiment 3

Figure 9:
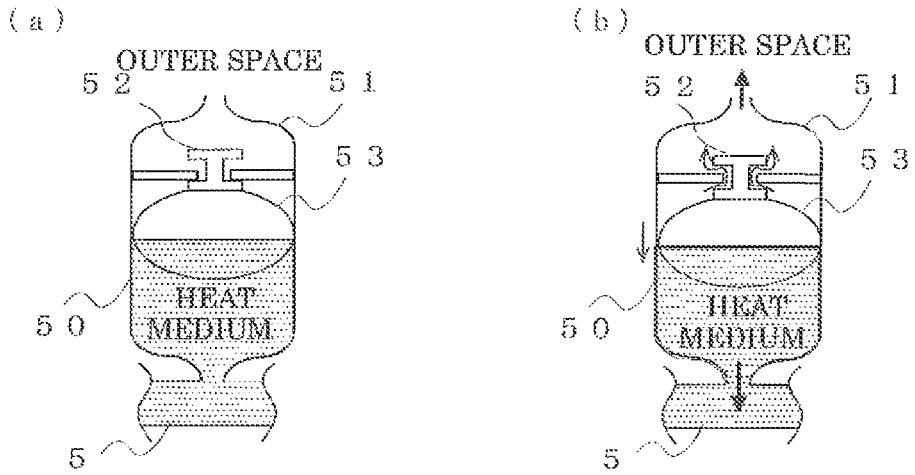
FIG. 9 is a diagram showing the configuration of an air purge apparatus 50 according to Embodiment 3.

FIG. 9 is a diagram showing a configuration of an air purge apparatus 50 provided in the heat medium circulation circuit according to Embodiment 3 of the present invention. In FIG. 9, the air purge apparatus 50 has a container 51, an air purge valve (valve) 52, and a float 53. Here, in the present embodiment, descriptions will be given assuming that the upper side is the vertical upper direction and the lower side is the vertical lower direction. The container 51 accommodates the air purge valve 52 and the float 53. The container 51 also has a vent hole that makes the heat medium circulation circuit communicate with an outer space. The air purge valve 52 creates a gap in the vent hole to shut off it by being displaced vertically in the container 51. The float 53 has a buoyant force against the heat medium and is displaced vertically in the container 51 according to the liquid level of the heat medium. In synchronization with the displacement, the air purge valve 52 can be displaced vertically.

In the heat medium circulation circuit, the heat medium is made to circulate under the condition in which inside the pipeline to be a flow path of the heat medium is filled with the heat medium. However, gases are sometimes generated in the pipelines where the heat medium circulates, by the remaining air (gases) prior to filling or the deposit of gasses dissolved into the heat medium. In the heat medium circulation circuit, the heat medium is made to circulate by the pumps 21*a* and 21*b*. Here, when the pumps 21*a* and 21*b* suck the air in the pipeline, since what is called an air biting occurs. Consequently, the pressure at the time of sending out is absorbed by the air and the heat medium of a predetermined flow amount sometimes cannot be carried out. Therefore, the present embodiment is configured to provide an air purge apparatus that automatically discharges the air in the pipeline in the heat medium circulation circuit.

When the amount of the gas (the air) is small and the amount of the heat medium is large in the container 51, as shown in FIG. 9(*a*), the liquid level of the heat medium is located at upper part in the container 51. Consequently, the buoyant force of the float 53 pushes up the air purge valve 52, which shuts off the gap between the vent hole and the outer space.

On the other hand, when the amount of the gas in the container 51 increases, as shown in FIG. 9(*b*), the liquid level of the heat medium in the container 51 is lowered because of the pressure of the gas. As a result, the position of the float 53 is lowered and the position of the air purge valve 52 goes down as well because the pushing up power of the air purge valve 52 weakens. When the position of the air purge valve 52 is lowered, a gap is created in the vent hole and the gas in the container 51 is discharged into the outside space. As the amount of the gas (air) in the container 51 becomes small by the discharge, the liquid level of the heat medium rises to push up the air purge valve 52 and shuts off the gap of the vent hole again. Consequently, no heat medium flows out into the outside space.

Here, two or more air purge apparatuses 50 may be provided in the heat medium circulation circuit. In order to make the gas effectively stored in the container 51 of the air purge apparatus 50, it is desirable to install the air purge apparatus 50 at a position as higher as possible in the heat medium circulation circuit. Here, when the indoor unit 2 is installed at a higher position in the heat medium circulation circuit for example, the air purge apparatus 50 is preferably installed at a higher position of the pipeline in each indoor unit 2.

Further, it is possible to perform cooling and heating mixed operation in the above-mentioned air-conditioner apparatus, for example. Therefore, in the heat medium circulation circuit, the air purge apparatus 50 may be provided in each flow path through which the heated heat medium and cooled heat medium flow.

As described above, in the air-conditioner apparatus of Embodiment 3 as mentioned above, since the air purge apparatus 50 is provided in the heat medium circulation circuit, the air in the heat medium circulation circuit can be automatically discharged from the air purge apparatus 50 by making the heat medium circulate. Therefore, a carrying power loss at the time of sending out the heat medium can be reduced especially in the pumps 21*a* and 21*b*.

Embodiment 4

Figure 10:
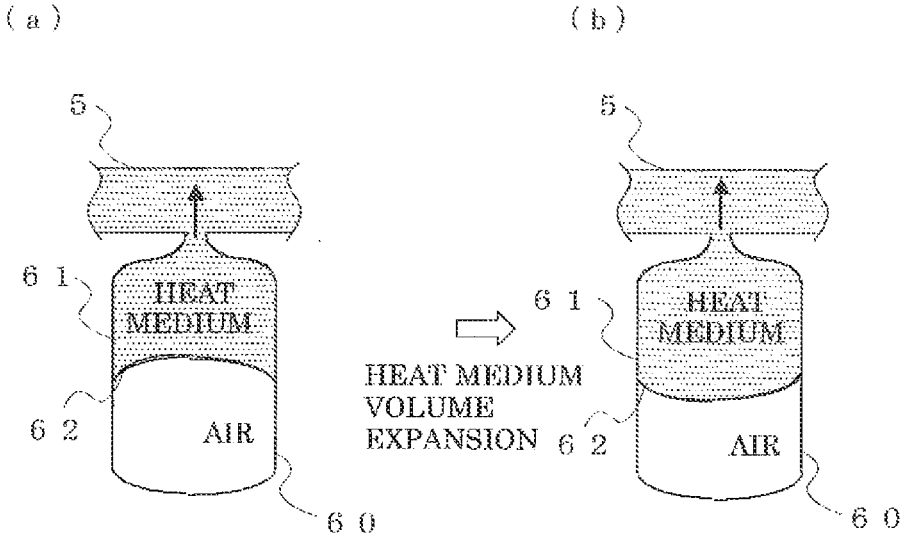
FIG. 10 is a diagram showing the configuration of a pressure buffer apparatus 60 according to Embodiment 4.

FIG. 10 is a diagram showing the configuration of a pressure buffer apparatus provided in the heat medium circulation circuit according to Embodiment 4 of the present invention. The pressure buffer apparatus 60 in FIG. 10 is an expansion tank having a container 61 and a buffer partition (separating membrane) 62. The container 61 having a buffer partition 62 as a boundary accommodates the heat medium that buffers the pressure and the air that absorbs the displacement of the buffer partition 62. The buffer partition 62 displaces by the pressure received from the heat medium, for example. In particular, by expanding so as to accommodate the heat medium corresponding to the increased volume, the pressure to which the pipeline of the heat medium circulation circuit is subjected is absorbed. Here, a closed type expansion tank is given as an example. However, an open type expansion tank may be used for configuration. Here, in the heat medium circulation circuit, it is desirable that the pressure buffer apparatus 60 are provided in both flow paths where the heated heat medium and cooled heat medium flow respectively.

As mentioned above, the heat medium is filled in the heat medium circulation circuit. However, when the temperature rises, the volume of the heat medium increases, and when the temperature decreases, the volume decreases. In the case of liquids such as water, in particular, there is a possibility that a large pressure may be imposed from inside of the heat medium pipeline 5 to cause damages and the like. Therefore, the pressure buffer apparatus 60 is provided and when the temperature of the heat medium changes, the volume of the heat medium in the container 61 is made to change to make the volume in the pipeline in the heat medium circulation circuit to be constant, as shown in FIG. 10(*b*). Consequently, even when the volume of the heat medium increases/decreases, the pressure of the heat medium applied to the pipeline is kept constant, allowing prevention of damages of the pipeline.

Embodiment 5

In the above-mentioned embodiment, descriptions are given to the air-conditioner apparatus that can combine cooling and heating simultaneously as an example. However, it is not limited thereto. For example, the installation relation of the indoor units 1 and 2 and the relay unit 3 can be applied to the air-conditioner apparatus dedicated only to cooling or heating. Then, there is no need to separate the flow paths of the heat medium for heating and that for cooling in the heat medium circulation circuit. Therefore, there is no need to connect apparatuses such as the flow path switching valves 22*a* to 22*d* and 23*a* to 23*d*. Moreover, there is no need to provide at least one or more intermediate heat exchangers 15*a* that heats the heat medium and the intermediate heat exchangers 15*b* that cools the heat medium, respectively.

The invention claimed is:

1. An air-conditioner apparatus, comprising:

a refrigeration cycle that connects a compressor that pressurizes a refrigerant, a refrigerant flow path switching apparatus that switches a circulation path of said refrigerant, a heat source side heat exchanger that makes said refrigerant exchange heat, a plurality of expansion valves that adjust the pressure of said refrigerant, and a plurality of intermediate heat exchangers that exchange heat between said refrigerant and a heat medium different from said refrigerant, by piping, a heat medium circulation circuit that connects an intermediate heat exchanger of said plurality of intermediate heat exchangers, a pump that makes said heat medium related to heat exchange of said intermediate heat exchanger circulate, and a plurality of use side heat exchangers that exchange heat between said heat medium and the air related to an air-conditioning space, by piping, wherein a heat source apparatus that is installed in an outdoor space of a building or in a space connected to the outdoor space accommodates said compressor, said refrigerant flow path switching apparatus, and said heat source side heat exchanger, and a relay unit that is provided in a non-air-conditioning space, which is different from said air-conditioning space and said outdoor space, accommodates said plurality of expansion valves, said pump, said plurality of intermediate heat exchangers, a plurality of heat medium flow path switching apparatuses and a plurality of pipelines including branches, the heat source apparatus and the relay unit are connected by only two pipelines to form said refrigeration cycle, and wherein each of a plurality of indoor units that accommodate a respective one of said use side heat exchangers is installed at a position where said air-conditioning space is capable of being air-conditioned, said relay unit and each of said indoor units are connected by only two pipelines, respectively, from outside of a wall which partitions the inside and the outside of said air-conditioning space, to form said heat medium circulation circuit, one of said plurality of pipelines including branches connects one of said plurality of intermediate heat exchangers and a plurality of said indoor units, said plurality of heat medium flow path switching apparatuses are disposed on respective branches of said plurality of pipelines including branches, and the air-conditioner apparatus has a simultaneous cooling and heating operation in which heating of said heat medium by at least one of said plurality of intermediate heat exchangers and cooling of said heat medium by at least another one of said plurality of intermediate heat exchangers are performed simultaneously, and said heated heat medium is fed to a use side heat exchanger of an indoor unit performing heating and said cooled heat medium is fed to a use side heat exchanger of another indoor unit performing cooling by switching some or all of said heat medium flow path switching apparatuses, wherein when a heating only operation is performed, at least one of said plurality of expansion valves adjusts the pressure of said refrigerant that flows from an intermediate heat exchanger for heating, said intermediate heat exchanger for heating is one of said plurality of intermediate heat exchangers and heats said heat medium, when a cooling only operation is performed, at least another one of said plurality of expansion valves adjusts the pressure of said refrigerant that flows from said heat source side heat exchanger and flows into an intermediate heat exchanger for cooling, said intermediate heat exchanger for cooling is one of said plurality of intermediate heat exchangers and cools said heat medium, and when the simultaneous cooling and heating operation is performed, at least one of said plurality of expansion valves adjusts the pressure of said refrigerant between said intermediate heat exchanger for heating and said intermediate heat exchanger for cooling.

2. The air-conditioner apparatus of claim 1, wherein said relay unit performs said simultaneous cooling and heating operations by distributing the heat medium made to flow into each set of said two pipelines between said relay unit and said indoor units for heating use and cooling use.

3. The air-conditioner apparatus of claim 2, wherein each intermediate heat exchanger is divided into said intermediate heat exchanger for cooling that cools said heat medium and said intermediate heat exchanger for heating that heats said heat medium, and said relay unit has pipelines that connect said plurality of expansion valves with said intermediate heat exchanger for cooling and intermediate heat exchanger for heating so as to make all amount of said refrigerant circulating through said refrigeration cycle flow through at least one of said intermediate heat exchanger for cooling and intermediate heat exchanger for heating.

4. The air-conditioner apparatus of claim 1, wherein said relay unit and said indoor units are installed in the ceiling space on the same floor and a difference in height of the pipeline across said air-conditioning space and said non-air-conditioning space is suppressed to be equal to or less than the height of said ceiling space.

5. The air-conditioner apparatus of claim 1, wherein said relay unit is provided in a space other than an upside of a living room which is said air-conditioning space in said building.

6. The air-conditioner apparatus of claim 1, wherein in said refrigeration cycle, said plurality of intermediate heat exchangers are constituted by said intermediate heat exchanger for heating that has a function to heat said heat medium by making said refrigerant release heat and said intermediate heat exchanger for cooling that has a function to cool said heat medium by making the refrigerant absorb heat, and said heat medium circulation circuit is connected by piping with the plurality of heat medium flow path switching apparatuses that switch flow paths for allowing said heat medium related to heating by said intermediate heat exchanger for heating to pass to the use side heat exchanger that heats the air in said air-conditioning space, or for allowing said heat medium related to cooling by said intermediate heat exchanger for cooling to pass to the use side heat exchanger that cools the air in said air-conditioning space.

7. The air-conditioner apparatus of claim 3, wherein each of said heat medium flow path switching apparatuses is configured by providing a two-way switching valve or a three-way switching valve at the flow-in side and flow-out side of the heat medium of said use side heat exchanger respectively.

8. The air-conditioner apparatus of claim 6, wherein in said heating only operation, said high temperature refrigerant is made to circulate through said intermediate heat exchanger for heating and said heat medium related to heating is made to circulate through the heat medium circulation circuit, in said cooling only operation, said low temperature refrigerant is made to circulate through said intermediate heat exchanger for cooling and said heat medium related to cooling is made to circulate through the heat medium circulation circuit, and in said simultaneous cooling and heating operation, the refrigerant is made to pass through said intermediate heat exchanger for heating and said intermediate heat exchanger for cooling, and the heat medium is independently made to circulate through a heat medium flow path related to heating and a heat medium flow path related to cooling by said plurality of heat medium flow path switching apparatuses.

9. The air-conditioner apparatus of claim 1, further comprising:

a heat source apparatus side controller that controls apparatuses constituting said heat source apparatus; and the relay unit side controller communicates with said heat source apparatus side controller, wherein control signals including data of the control target values of the condensing temperature and/or evaporating temperature of said refrigerant in an intermediate heat exchanger of the plurality of intermediate heat exchangers or their adjustment values are transmitted from said relay unit side controller to said heat source apparatus side controller.

10. The air-conditioner apparatus of claim 1, wherein in said heat medium circulation circuit, a use side heat exchanger bypass pipeline that connects the inlet side flow path and outlet side flow path of the heat medium in a respective use side heat exchanger, a use side flow amount control apparatus that adjusts the flow amount of said heat medium passing through said respective use side heat exchanger, a heat medium temperature sensor that detects the temperature of said heat medium flowing into said respective use side heat exchanger, and the temperature of said heat medium having flowed out of said respective use side heat exchanger are further provided, and said use side heat exchanger bypass pipeline, said use side flow amount control apparatus and said heat medium temperature sensor are installed in said relay unit.

11. The air-conditioner apparatus of claim 1, wherein in said heat medium circulation circuit, a use side flow amount control apparatus that has a two-way flow amount adjustment valve for adjusting the flow amount of said heat medium passing through a respective use side heat exchanger, in the flow path at the inlet side or the outlet side of the heat medium in said use side heat exchanger, a heat medium temperature sensor that detects the temperature of said heat medium flowing into said respective use side heat exchanger and the temperature of said heat medium having flowed out of said respective use side heat exchanger are further provided, and said use side flow amount control apparatus and said heat medium temperature sensor are installed in said relay unit.

12. The air-conditioner apparatus of claim 1, wherein said heat medium circulation circuit further includes an automatic air purge apparatus that discharges the air in said heat medium circulation circuit into the atmosphere.

13. The air-conditioner apparatus of claim 1, wherein said heat medium circulation circuit further includes a buffer apparatus that buffers the volume change of both heated heat medium and cooled heat medium in said heat medium circulation circuit.

14. The air-conditioner apparatus of claim 1, wherein said heat medium is water.

15. The air-conditioner apparatus of claim 1, wherein said heat medium is water to which non-volatile or low-volatile preservatives in the air-conditioning temperature range is added.

16. The air-conditioner apparatus of claim 1, wherein said non-air-conditioning space is a space in the ceiling, or a common space where an elevator is installed, which is divided by a wall.

* * * * *